United States Patent [19]

Beasley

[11] 4,445,446

[45] May 1, 1984

[54] KNIFE HOLDER MODULE FOR CUT PILE TUFTING MACHINE

[75] Inventor: Max M. Beasley, Lookout Mountain, Ga.

[73] Assignee: Tuftco Corporation, Chattanooga, Tenn.

[21] Appl. No.: 445,236

[22] Filed: Jan. 26, 1983

[51] Int. Cl.[3] ..... D05C 15/00

[52] U.S. Cl. ..... 112/79 R

[58] Field of Search ..... 112/79 R

[56] References Cited

U.S. PATENT DOCUMENTS 4,195,580 4/1980 Hurst ..... 112/79 R 4,207,825 6/1980 Bleasdale ..... 112/79 R

FOREIGN PATENT DOCUMENTS 2808137 8/1979 Fed. Rep. of Germany .... 112/79 R

*Primary Examiner*—Ronald Feldbaum

*Attorney, Agent, or Firm*—Harrington A. Lackey

[57] ABSTRACT

A knife holder module for a cut pile tufting machine including a solid knife block member having upright knife slots therethrough for receiving corresponding knives. The knife block member includes adjustable clamp elements for holding the knives within the corresponding knife slots in solid engagement with the knife block member. The rear face of the knife block member includes a rearward projecting transverse tongue member disposed at the tension angle of the knives for infinite transverse adjustment with the knife bar. The rear face of the knife block member is also disposed at an angle to the transverse alignment of the knives equal to the pitch angle of the knives. The knife bar is also adjustably mounted upon the bracket fixed to the knife shaft.

13 Claims, 6 Drawing Figures

KNIFE HOLDER MODULE FOR CUT PILE TUFTING MACHINE

BACKGROUND OF THE INVENTION

This invention relates to multiple-needle tufting machine, and more particularly to a knife holder module for a multiple-needle cut pile tufting machine.

Conventionally, the knives utilized in multiple-needle tufting machines for cooperation with looper hooks in order to seize, hold and cut yarns delivered to the looper hooks by the needles, have been supported in individual knife blocks, which are open on the sides and include tracks or guideways for engaging the opposite edge of each knife. Each knife block is provided wwith a rearward projecting cylindrical stud or rod which is adapted to be rotatably adjustably received in a corresponding hole in a knife bar. This structure permits the knifes to be set at the desired tension angles relative to the looper hooks. The holes in the knife bars are disposed at angles to the transverse dimension of the knife bar, which are equal to the pitch angle of the knife blades relative to the looper hooks. Each knife is secured in its knife block by threaded set screws, threadedly received within the knife block for movement toward and away from direct engagement with the edge of each knife.

Other prior art knife holders include knife blocks capable of supporting multiple numbers of knives, such as two or three knives. Furthermore, in some knife blocks, one set screw may be utilized to secure two knife blades, instead of one.

Examples of typical knife holders for multiple needle cut pile tufting machines are shown in the following U.S. Pat. Nos.: 3,277,852, Card, Oct. 11, 1966; 4,003,321, Card, Jan. 18, 1977; 4,067,270, Short Jan. 10, 1978.

SUMMARY OF THE INVENTION

It is therefore an object of this invention to provide in a multiple-needle cut pile tufting machine, an improved cutter apparatus including a solid block member, which not only holds, but also solidly reinforces the knives as they reciprocally move at rapid speeds for cooperation with the looper hooks to cut the yarns to form cut pile tufts.

The solid knife holder members are preferably formed in short transverse lengths to form modules. Each module includes a plurality of parallel, generally vertically disposed, or upright, knife slots, each slot adapted to snugly receive a corresponding knife in snug, but slidable, relationship. Each pair of knives are secured at a predetermined elevated position relative to the knife block member by means of small cylindrical clamp elements or studs adapted to freely travel forward and rearward toward and away from engagement with the front edge or edges of knives received within the knife slots. Each clamp element or stud is in coaxial alignment and engagement with a set screw projecting through the front face of the knife block member. Thus, as a set screw is turned to force a clamp stud toward the front edge or edges of corresponding knife blades, only the set screw is turning. Each clamp element or stud moves only coaxially of its length, and does not turn or twist. Thus, no turning or twisting movement of the set screw is transmitted to the knife blades. Moreover, the clamping studs provide a more effective bearing or seat for engaging the front edge of a corresponding knife blade.

Each knife holder module is provided with means pre-setting the attitude of the knife holder module relative to the knife bar, so that the tension angle and pitch angle of the knives is automatically established when the knife holder module is secured to the knife bar. In order to establish the tension angle, an elongated, transverse tongue member projects rearward from the rear face of the module at an angle to the transverse dimension of the knife bar for reception in a corresponding slot in the front face of the knife bar. The pitch angle of the knives is determined by constructing the rear face of the knife block holder at an angle equal to the pitch angle relative to the transverse dimension of the knife bar.

The knife bar is adjustably mounted upon the bracket of the drive shaft, so that the knife bar can be set at different elevations relative to the drive bracket.

Thus, the elevation of the knives may be vertically adjusted, either by adjustment provided between the drive bracket and the knife bar, or between the set screws and clamp elements and the knives in the knife slots.

DESCRIPTION OF THE PREFERRED EMBODIMENTS

Figure 1:
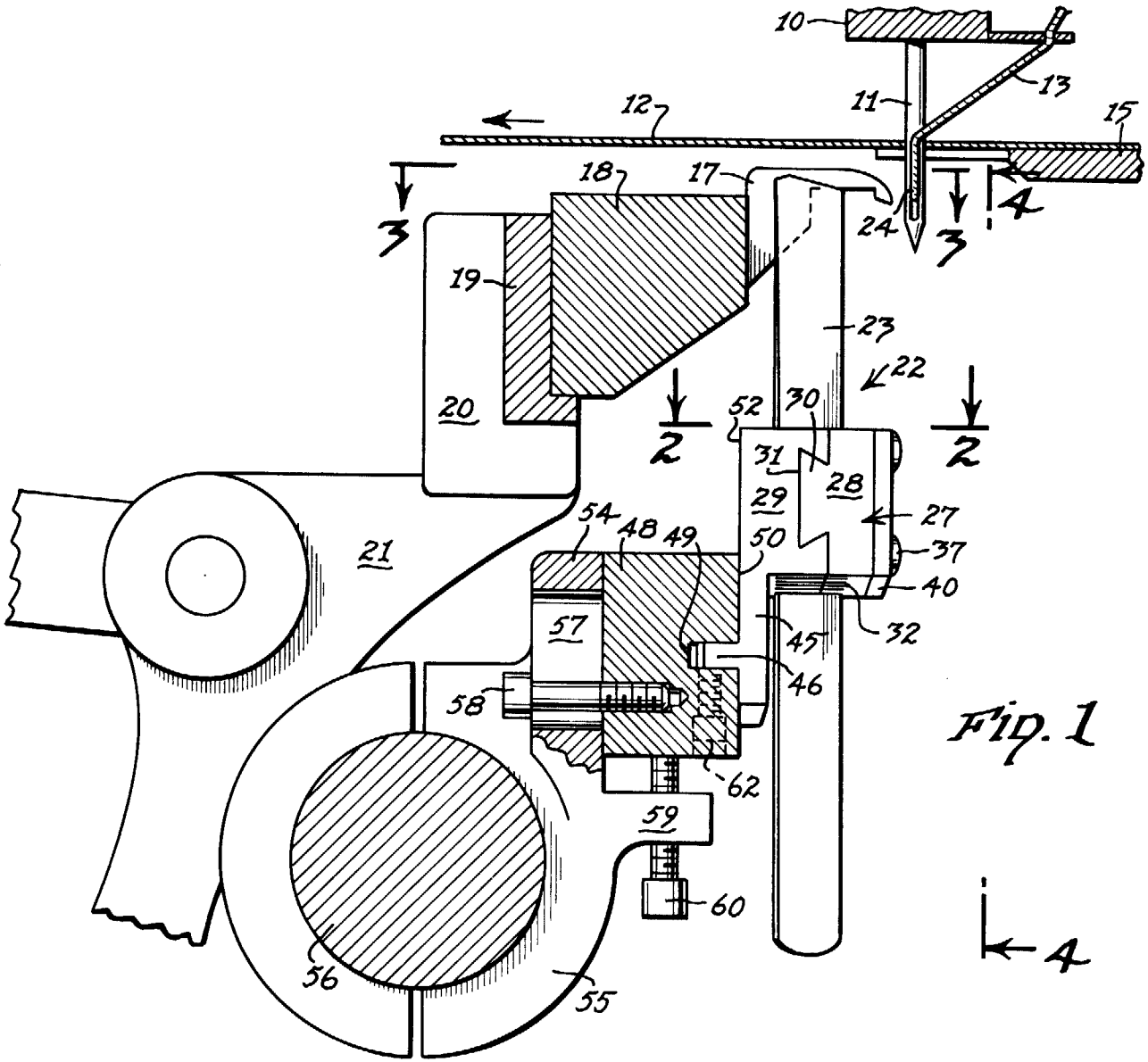
FIG. 1 is a fragmentary sectional elevation of a portion of a multiple-needle tufting machine, illustrating the cutting apparatus made in accordance with this invention.

Referring now to the drawings in more detail, FIG. 1 discloses a transverse needle bar 10 in a conventional multiple-needle tufting machine supporting a row of uniformly spaced needles 11 extending transversely of the machine. The needle bar 10 is vertically reciprocated by conventional means, not shown, to cause the needles 11 to move between an upper position above the base fabric 12 and a lower position penetrating the base fabric 12, so that the needles 11 will carry yarns 13 through the base fabric 12 to form loop of tufting therein. The base fabric 12 is supported upon a needle plate 15 for movement, by means not shown, in the direction of the arrow of FIG. 1, that is longitudinally from front-to-rear through the machine.

Cooperating with each needle 11 is a cut pile looper hook 17. A plurality of the looper hooks 17 are carried in the transverse hook bar 18 fixed upon a shim bar 19, which in turn is supported upon a plurality of brackets 20 carried by rocket arms 21 journaled on a rock shaft, not shown, and driven by conventional means connected to the rocker arms 21 for limited reciprocal movement in synchronism with the reciprocal movement of the needles 11.

The cutting apparatus 22 made in accordance with this invention includes a plurality of knives 23, each knife 23 being adapted to cooperate with a corresponding looper hook 17 for cutting yarn loops 24 on the hooks to form cut pile tufts.

The cutting apparatus 22 includes a knife holder module in the form of a knife block member 27, preferably constructed from a front section 28 and a rear section 29, secured together by a cooperating transverse tongue 30 and a transverse cooperating groove 31. The knife block member 27 is solid throughout except for the transversely spaced elongated upright, or vertically disposed, knife slots 32. Each knife slot 32 has a widthwise dimension only slightly greater than the width of each corresponding knife 23. The thickness of each knife slot 32 is substantially equal to the thickness of each corresponding knife 23 so that each knife 23 has a snug sliding fit to permit each knife 23 to be vertically moved by hand relative to the corresponding knife slot 32. Thus, each knife 23 is completely surrounded by, and substantially engages, solid material in the block member 27, so that each knife 23 has firm, solid reinforced support throughout the vertical extent of the knife portion within its corresponding knife slot 32.

The front portion of each knife slot 32 is formed in the front section 28, while the rear portion of each knife slot 32 is formed in the rear section 29. Thus, when the front and rear sections 28 and 29 are secured together, the knife slot portions align to form a completely enclosed slot 32, except for their openings through the top face 33 and the bottom face 34 of the knife block member 27.

The face surface 35 of the front block section 28 is provided with a plurality of (4 disclosed in the drawings) threaded holes 36 for receiving corresponding threaded bolts 37, which also pass through corresponding bolt holes 38 in a cap or cover plate 40, for securing the cover plate 40 to the front block section 28.

Figure 6:
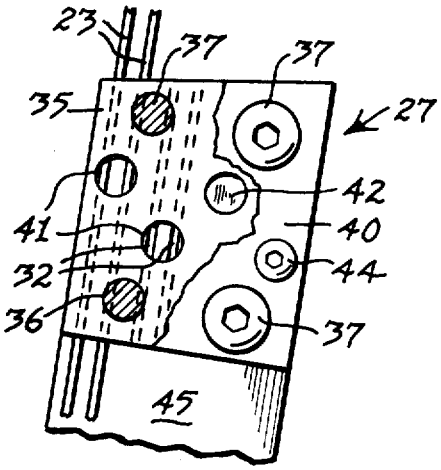
FIG. 6 is a fragmentary front elevation of the knife block member disclosed in FIG. 5, with portions of the cap plate broken away.

Also formed through the face surface 35 into the front block section 28 are a plurality of clamp holes 41. As disclosed in FIG. 6, each clamp hole 41 is aligned front-to-rear with a pair of adjacent knife slots 32. Each clamp hole 41 is disclosed as being cylindrical for receiving a cylindrical clamp element 42, such as a stud or insert. As disclosed in FIG. 6, there are four clamp holes 41 intercepting adjacent pairs of a total of eight knife slots 32.

Figure 4:
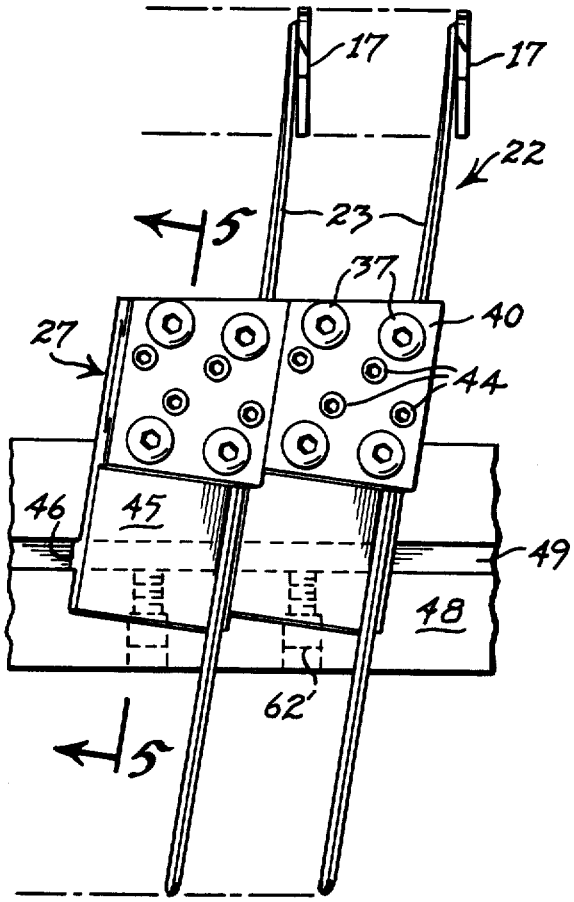
FIG. 4 is a fragmentary front elevation of the cutting apparatus, taken along the line 4—4 of FIG. 1.
Figure 5:
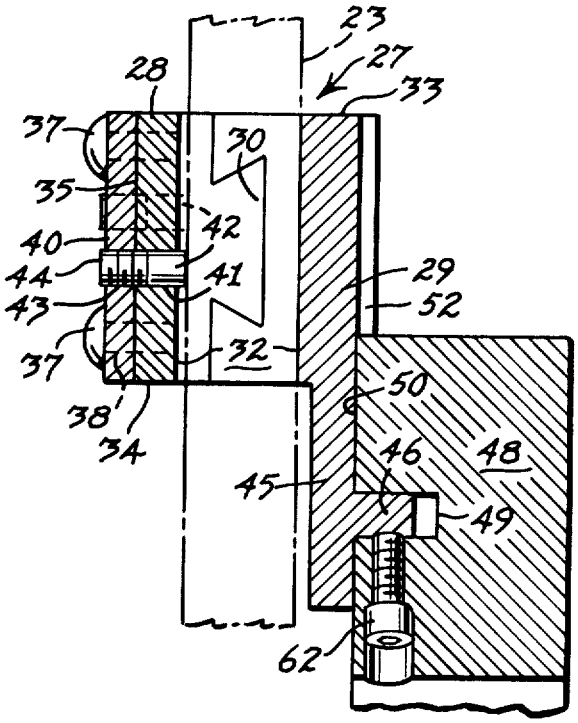
FIG. 5 is an enlarged fragmentary section, taken along the line 5—5 of FIG. 4.

Threadedly received within corresponding threaded holes 43 in the cap plate 40 are corresponding set screws 44. As disclosed in FIGS. 4 and 5, there are four threaded holes 43, each of which is in coaxial alignment with a clamp hole 41. Thus, when a set screw 44 is tightened in its corresponding hole 43, the set screw 44 drives the clamp element 42 toward a corresponding pair of knife slots 32 to engage and tighten against the front or leading edges of knife slots 32. As the set screw 44 is turned or rotated, it bears against the clamp element 42 to thrust it coaxially of the clamp hole 41, without turning the clamp element 42. The clamp element 42 has a flat end, so that it bears evenly against both leading edges of the corresponding knives 23 without twisting or rotating. Thus, the clamp element 42 provides a better securing seat for holding and gripping the knives 23 without damaging or marring the knives 23.

The rear block section 29 is provided with a depending flange portion 45 having a rearward projecting tongue member or rib member 46. The transversely extending tongue member 46 is set at an angle to a transverse line which is perpendicular to the knife slots 32. This angle is equal to the tension angle of the knifes 23 relative to the looper hooks 17.

A transverse knife bar 48 is provided with a transverse slot or groove 49 in it front face 50. The tongue member 46 is adapted to slidably fit within the transverse groove 49, so that the module or block member 27 may be infinitely adjusted in a transverse direction to set the knives 23 at the proper gauge and proper tension relative to their corresponding looper hooks 17.

The rear face 52 of the rear section 29 is planar and disposed at an angle to the front face 50 of the knife bar, which angle is equal to the pitch angle of the knives relative to the looper hooks 17.

Figure 2:
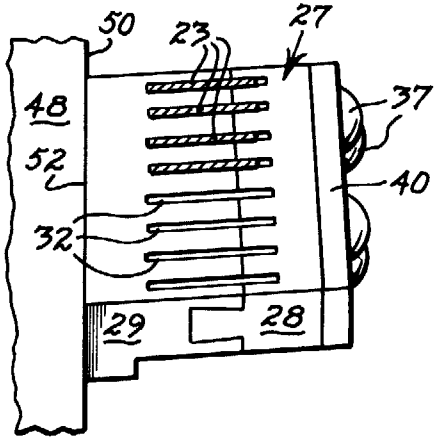
FIG. 2 is an enlarged fragmentary section, taken along the line 2—2 of FIG. 1.
Figure 3:
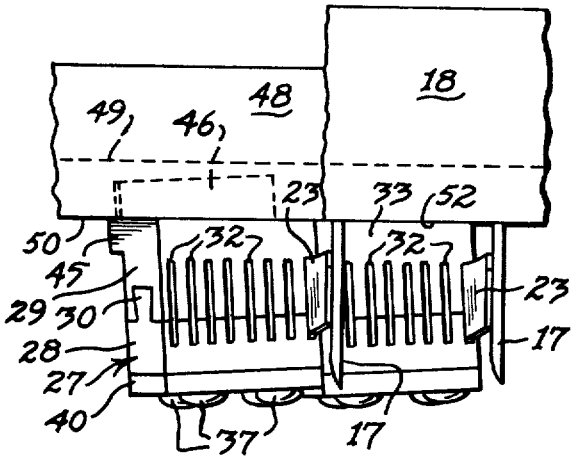
FIG. 3 is a fragmentary plan view, taken along the line 3—3 of FIG. 1, with the needles removed.

To maintain the knives 23 in substantial transverse alignment with the longitudinal extent of the knife bar 48, the rear ends of pairs of knife slots 32 are staggered relative to each other, as best disclosed in FIG. 2, so that the rear ends of the knife slots will be in alignment substantially parallel to the angular rear face 52 of the block section 29.

Thus, the block member 27 is predesigned to set the pitch angle and the tension angle when the block member 27 is properly mounted upon the knife bar 48.

As disclosed in FIG. 1, the knife bar may be mounted upon the upstanding flange 54 of the bracket 55 fixed to the transverse reciprocal knife shaft 56. The knife shaft 56 is driven by means, not shown, in timed relationship with the drive for the needles 11 and the looper hooks 17, in a conventional manner.

A vertical elongated slot 57 is formed in the bracket flange 54 for receiving a locking bolt 58 threadedly secured to the rear portion of the knife bar 48. Thus, by releasing the locking bolt 58, the knife bar 48 may be raised and lowered relative to the flange 54 and locked in place by tightening the locking bolt 58.

A forwardly projecting flange 59 beneath the hook bar 48 supports a vertical adjustment bolt 60, the upper end of which abuts flush against the bottom face of the knife bar 48. The adjustment bolt 60 is utilized to support the knife bar 48 in its various adjustment positions, and may be utilized to actually adjust the height of the knife bar relative to the bracket flange 54, when the locking bolt 58 is loosened.

Set screws 62 are threaded through the bottom portion of the hook bar 48 for securing the tongue members 46 in their respective slots 49.

In the operation of the cutting apparatus 22, each module or block member 27 may be removed from the knife bar by loosening the set screws 62. The knives 23 may be vertically adjusted within their corresponding knife slots 32 by loosening the set screws 44 and manually moving the knives 23 up or down within the block member 27. After the proper elevation or vertical adjustment of the knives 23 has been completed, the set screws 44 are then tightened to lock the knives 23 within their slots 32.

Either while the module 27 is removed from the knife bar 48, or even while it is assembled upon the knife bar, the knife bar 48 may be vertically adjusted relative to the bracket flange 54 by loosening the locking bolt 58 and turning the adjustment bolt 60 in the appropriate direction for raising or lowering the knife bar 48. Then when the proper adjustment of the knife bar 48 has been attained relative to the bracket flange 54, the locking bolt 58 is tightened.

When the modular block member 27 is assembled upon the knife bar 48 by inserting the tongue member 46 within the groove 49, the knife module 27 is moved transversely causing the tongue member 46 to slide longitudinally within the groove 49 until the knives 23 are properly tensioned and located relative to their corresponding looper hooks 17. After the knives 23 are set, the set screws 62 are tightened.

In its operative position, the knife module 27 firmly and solidly holds and reinforces the portions of the knives 23 within the knife slots 32, so that the knives 23 are held accurately in their operative positions for cooperating with and cutting yarn upon the looper hooks 17.

Since the block member 27 are preferably formed in modules, each supporting approximately eight knives 23, maintenance and adjustment of the knives are easily attained by simply transversely shifting or completely removing any one module with respect to the knife bar 48.

The cutting apparatus 22 made in accordance with this invention provides improved gauge accuracy and provides pre-set compound angles, including the tension angle and the pitch angle, of the knife blades 23 relative to the looper hooks 17. The portions of the knives 23 within the knife slots 32 are completely surrounded and held contiguously by the solid metal of the block member 27.

The knives 23 are not contacted directly by any set screws for adjustment and securing the same within their corresponding knife slots 32.

The continuous transverse groove 49 in the knife bar 48 permits infinite transverse adjustment of the modules and the knives with respect to the looper hooks 17 and the knife bar 48, by its interconnection with the tongue members 46.

Vertical adjustment of the knives 23 and knife bar 48 is easily effected, not only by easily and quickly adjusting the knives 23 relative to their knife slots 32 through the set screws 44, but also through the vertical adjustment mechanism between the bracket 55 and the knife bar 48 including the locking bolt 58 and the vertical adjustment bolt 60.

The knife module 27 made in accordance with this invention is substantially stronger and more stable and durable than conventional knife blocks used in multiple needle cut pile tufting machines.

What is claimed is:

1. In a cut pile tufting machine having means for supporting a base fabric for longitudinal movement in a tufting direction through said machine, a plurality of transversely spaced reciprocal needles for introducing yarns through said base fabric to form loops, a looper hook for each needle on the opposite side of the base fabric from the needles and adapted to cooperate with a corresponding needle to seize and hold a yarn carried by the needle to form a loop, a cutting apparatus comprising:

(a) a knife holder module comprising a block member having front and rear portions and top and bottom faces, (b) a plurality of elongated knife slots extending upright through said block member and opening through said top and bottom faces, each of said knife slots having a widthwise dimension extending front-to-rear of said block member, (c) said block member comprising a front section and a rear section, said front section including front portions of said knife slots and having an extending locking member, said rear section including rear portions of said knife slots and having a cooperating locking member adapted to cooperate with said extending locking member in an operative position for securing said front and rear sections together to form a knife block member having corresponding knife slots, each of which completely surrounds and is in substantial solid contact with a corresponding knife received in said knife slot, (d) a plurality of elongated knives, each knife being received in a corresponding knife slot for longitudinal slidable movement, (e) adjustable securing means in said block member for engaging and holding each knife in said corresponding knife slot, (f) a knife bar, (g) means securing said block member on said knife bar, (h) drive means for reciprocably moving said knife bar so that said knives cooperate with corresponding looper hooks for cutting loops on the looper hooks to form cut pile tufts.

2. The invention according to claim 1 in which said means securing said block member on said knife bar comprises means for infinitely adjusting sid knife block member transversely of the tufting direction relative to said knife bar.

3. The invention according to claim 2 in which said means securing said block member on said knife bar comprises a transverse tongue member projecting rearwardly from the rear portion of said knife block member, and an elongated slot in the front of said knife bar for transversely slidably receiving said tongue member.

4. The invention according to claim 1 in which said drive means comprises a transverse drive shaft, a bracket fixed to said drive shaft and adjustable means securing said knife bar upon said bracket for upright adjustable movement.

5. The invention according to claim 4 in which said adjustable means comprises an elongated upright slot in said bracket and a threaded bolt member received in said slot and in said knife bar for adjustably mounting said knife bar on said bracket.

6. The invention according to claim 5 in which said knife bar comprises a bottom face, an adjustable support screw threadedly secured in said bracket for abutment against said bottom face of said knife bar for supporting said knife bar in various upright adjusted positions.

7. The invention according to claim 3 in which said transverse tongue member is fixed to the rear portion of said knife block member at an angle perpendicular to the knife slots in said block member equal to the tension angle of said knives.

8. The invention according to claim 2 in which said knife bar has a front face and said knife block member has a rear face for abutting flush against the front face of said knife bar, said rear face of said block member being disposed at a transverse angle relative to a transverse line normal to said knife slots in said block member equal to the pitch angle of said knives.

9. The invention according to claim 8 in which the widths of said knife slots are staggered relative to said transverse line normal to said knife slots.

10. The invention according to claim 1 in which said adjustable securing means comprises clamp elements in said block member movable toward and away from engagement with the edges of the knives received in said knife slots, and means for moving said clamp elements toward engagement with said knife edges.

11. The invention according to claim 10 in which each clamp element is adapted to engage the edges of an adjacent pair of knives, there along one clamp element for each pair of knives.

12. The invention according to claim 11 in which each clamp element is a clamp stud received for free movement toward and away from the front edges of the knives in said corresponding knife slots, a set screw for each clamp stud threadedly received within the front portion of said knife block member and adapted to be moved toward and away from, and in longitudinal alignment with, each corresponding clamp stud and to force said clamp stud toward engagement with a pair of corresponding knife edges.

13. The invention according to claim 1 in which said extending locking member and said cooperating locking member comprise tongue and groove members on opposing faces of said front and rear sections to hold said front and rear sections together.

* * * * *